US006527434B1

(12) United States Patent
Fox et al.

(10) Patent No.: US 6,527,434 B1
(45) Date of Patent: Mar. 4, 2003

(54) TIMEKEEPING DEVICE

(75) Inventors: George Fox, Bristol, CT (US); Aaron Szymanski, Bristol, CT (US); Karl Vanderbeek, New Haven, CT (US)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 09/758,622

(22) Filed: Jan. 11, 2001

Related U.S. Application Data

(60) Provisional application No. 60/176,216, filed on Jan. 14, 2000.

(51) Int. Cl.[7] ..... G04B 37/00; G04B 37/12

(52) U.S. Cl. ..... 368/276; 368/278; D10/31

(58) Field of Search ..... 368/276, 278, 368/280, 282, 316–317; D10/31, 2, 6

(56) References Cited

U.S. PATENT DOCUMENTS 2,952,967 A * 9/1960 Nussle ..... 368/281
4,357,694 A * 11/1982 Montouri ..... 368/282
4,879,702 A * 11/1989 Gardner ..... 368/282
5,438,555 A * 8/1995 Kim ..... 368/10
D362,398 S 9/1995 Gebhardt
D370,406 S 6/1996 Tsai
5,828,541 A * 10/1998 Wu ..... 368/278
6,234,668 B1 * 5/2001 Cooper ..... 368/281
D445,039 S * 7/2001 Finkay ..... D10/31

OTHER PUBLICATIONS

Sample carabiner from Internet (http://www.subdesign.it/english/rings_carabiners_tools.html) p. 2 of 4.

* cited by examiner

*Primary Examiner*—Randy W. Gibson
*Assistant Examiner*—Michael L. Lindinger
(74) *Attorney, Agent, or Firm*—Carmody & Torrance LLP

(57) ABSTRACT

A timekeeping device comprising a housing; timekeeping functionality positioned within the housing and a clip assembly integrally coupled to the housing, wherein the clip assembly comprises a first member and a second member hingedly coupled to the first member at a hinge point, whereby pressure against the second member causes the second member to rotate relative to the first member about the hinge point to permit coupling of the timekeeping device to an object of interest. In a particular configuration, the second member is releasably engageable with the first member. Additionally, the housing may include a receptacle for receiving a casing within which the timekeeping functionality that maintains the timekeeping functions is disposed. Preferably, the housing and at least the first member are formed from a unitary mold, and preferably from plastic. The object of interest, for example, may be a backpack, beltloop or bicycle.

15 Claims, 1 Drawing Sheet

TIMEKEEPING DEVICE

RELATED TO U.S. APPLICATION DATA

This application claims the benefit of U.S. Provisional Application No. 60/176,216 filed on Jan. 14, 2000.

BACKGROUND OF THE INVENTION

The present invention relates generally to timekeeping devices and, in particular, to a timekeeping device having an integrally formed clip assembly for easy attachment about a user's clothing or outer garments, backpack, golf bag or other equipment such as a bicycle.

Manufacturers have long desired a watch construction that provides a user with easy access to the display to see the time. Most conventionally, watches and/or other timekeeping devices have been generally designed to be worn about a user's wrist. However, it is well known that watches and/or other timekeeping devices have been constructed to be adorned about other parts of the body, such as on a ring, pendent, or other articles.

With the increase in popularity of outdoor sports, such as hiking and biking, a need for timekeeping devices to be worn about one's outer garments and/or attached about one's equipment, has been increased. However, the current state of the art has not sufficiently fulfilled the need. That is, the constructions of such timekeeping devices have been less than desirable.

Accordingly, a timekeeping device that can be worn about a user's outer garments and/or attached to the user's equipment and, in particular, a device that facilitates the securing to and removal thereof is desired. The present invention fulfills the void in the state of the art and meets the aforementioned and below mentioned objectives.

SUMMARY AND OBJECTS OF THE INVENTION

Generally speaking, in accordance with the present invention, a timekeeping device that can be worn about a user's outer garments and can be attached to the user's equipment is provided. In a preferred embodiment, the timekeeping device comprises a housing; timekeeping functionality positioned within the housing; a clip assembly integrally coupled to the housing, wherein the clip assembly comprises a first member and a second member hingedly coupled to the first member at a hinge point, whereby pressure against the second member causes the second member to rotate relative to the first member about the hinge point to permit coupling of the timekeeping device to an object of interest. In a particular configuration, the second member is releasably engageable with the first member. Additionally, the housing may include a receptacle for receiving a casing within which the timekeeping functionality that maintains the timekeeping functions is disposed. Preferably, the housing and at least the first member are formed from a unitary mold, and preferably from plastic. The object of interest, for example, may be a backpack, beltloop or bicycle.

Accordingly, it is an object of the present invention to provide a timekeeping device that can be worn about a user's article of clothing and/or attached to the user's equipment.

Yet a further object of the present invention is to provide a timekeeping device that can be easily and rapidly secured to and removed from a user's article of clothing and/or equipment.

It is further object of the present invention to provide a timekeeping device that can be easily secured to and removed from an object other than one worn about a user's body, wherein the object includes a backpack, golf bag, bicycle or the like.

BRIEF DESCRIPTION OF THE DRAWINGS

The above set forth and other features of the invention are made more apparent in the ensuing Detailed Description of the Preferred Embodiments when read in conjunction with the attached Drawings, wherein.

DETAILED DESCRIPTION OF THE PREFERRED EMBODIMENT

Generally speaking, the present invention recognizes the advantageous hinging and locking construction that exists in carabiners and utilizes the technology thereof to achieve the present invention.

Figure 1:
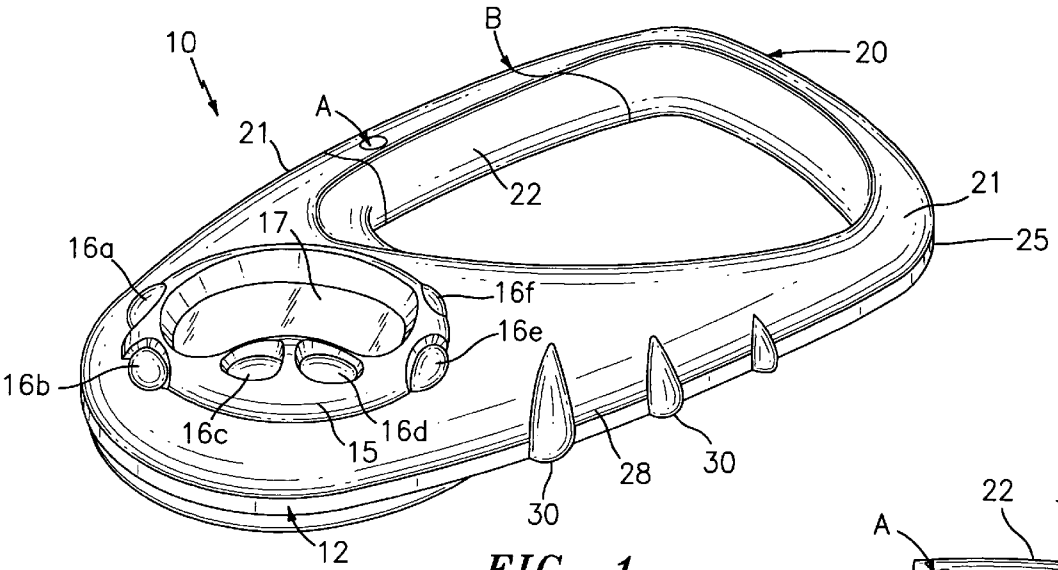
FIG. 1 is a perspective view of a timekeeping device constructed in accordance with a preferred embodiment of the present invention.

FIG. 1 illustrates a timekeeping device, generally indicated at 10, constructed in accordance with the present invention. The timekeeping device 10 is preferably comprised of a housing, generally indicated at 12, and a clip assembly, generally indicated at 20. In particular, the housing 12 includes a receptacle within which a casing 15 within which timekeeping functionality of a timekeeping device, similar to the head of a watch, are enclosed. The casing 15 may or may not be integrally formed with the housing 12. Details of the function of the timekeeping functionality, such as the inner electrical and/or mechanical components are omitted herein to maintain the clarity of the present invention, as the functionality thereof would be well understood by one skilled in the art.

The casing 15 may include function buttons, for example buttons 16A–F, which provide the functionality of the timekeeping device such as that disclosed in commonly owned U.S. Pat. Nos. 4,783,773; 4,780,864; 5,555,226 and 4,283,784, the disclosures of which are incorporated by reference as if fully set forth herein. For completeness however, it should be appreciated that casing 15 includes a display 17 and other appropriate components and features so as to provide a meaningful and complete timekeeping device.

Figure 2:
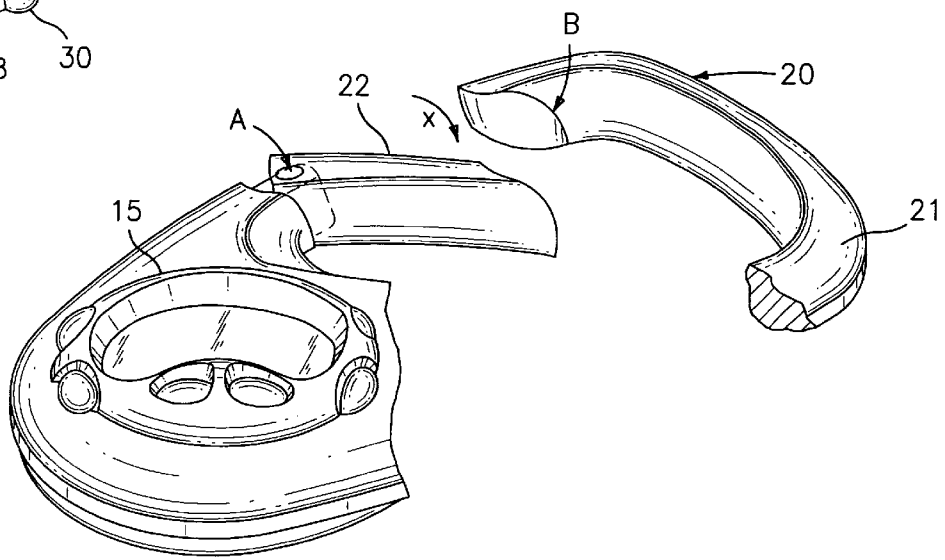
FIG. 2 is a partial prospective view of the timekeeping device of FIG. 1 that illustrates the operability of a clip assembly portion of the device.

In the preferred embodiment, and as alluded to above, housing 12 and clip assembly 20 may be provided in the shape of a carabiner (e.g. a D-shaped carabiner as shown in FIGS. 1 and 2). However, other shapes are believed to be within the scope of the present invention, and only limited by the imagination of the designer. In the preferred embodiment, housing 12 is integrally formed with clip assembly 20 so as to facilitate the molding thereof.

The clip assembly 20 preferably comprises a first member 21, preferably integrally formed with housing 12, that forms an elbow portion at reference number in FIG. 1. The clip assembly 20 also includes a second member 22, which is a pivoting arm or gate portion of the clip assembly 20. The second member 22 is hingedly attached to the first member 21 (e.g., by means of a pin and possible springbar or other spring member for biasing towards the closed position) at a hinged point A. The second member 22 is rotatable between the closed position (FIG. 1) and an open position (FIG. 2). In the closed position, the first member 21 and the second member 22 complete a closed loop configuration of the clip assembly 20 and the housing 12.

The hinging action, i.e. rotation between the open and the closed positions, of the clip assembly 20 is preferably operable in accordance with known carabiner hinge mechanisms and operations thereof and, accordingly, it is not believed that details thereof need be set forth herein. The second member 22 is preferably releasably engaged with the first member 21 at a point B. As should be appreciated, the locking action of the clip assembly 20 is preferably similar to known carabiner constructions and thus, is well understood to those of skill in the art. That is, for example, the spring action of a biasing member such as a spring at the hinge point A causes the releasable engagement of the second end of the second member to the first member.

While the preferred embodiment has been described with regard to the particular clip assembly configuration, the present inventors recognize that other clip assemblies are contemplated to be within the scope of the present invention. For example, other closure constructions to removably secure the timekeeping device 10 to an article of clothing (i.e. a belt or beltloop), backpack, golf bag or other device such as a bicycle, may be used. Additionally, other gate or pivoting closures mechanisms found on other state of the art carabiners can be incorporated herein while remaining in the scope of the present invention. For example, wire or screw gate constructions may be used to eliminate snagging about clothing or other undesirable objects. Examples of such closures may be found in carabiners sold under the trade name KONG.

In view of the foregoing, the operation of the present invention should be now understood. In particular, when a user desires to either adorn the timekeeping device 10 about the user's article of clothing or other gear or device, such as the aforementioned backpack, golf bag, bicycle or other device, the user need only apply pressure or a force to the second member 22. By manual activation, e.g. in response to the application of pressure, the second member 22 releasably disengages from first member 21 at point B and rotates in a direction indicated by arrow X (FIG. 2). As shown in FIGS. 1 and 2, the rotation of member 22 is about hinge point A. In one embodiment, a biasing device such as, for example, a biasing spring, biases the second member 22 toward the closed position. As such, the second member 22 substantially remains and/or returns to the closed position until a force is applied sufficient to counteract the force of the biasing device.

Depending on the desired usage of the present invention, the display 17 may be oriented such that the display 17 faces the user when timekeeping device 10 is worn about a belt buckle for example, or may face away from the user, this is a personal preference and only a matter of design choice and forms not part of the invention.

Other design features such as a gripping area 28 having molded ribs 30 may be added for aesthetic purposes and to facilitate rotation of the second member 22 (in the direction indicated by arrow X).

What has been disclosed herein is a unique construction that incorporates timekeeping features into a timekeeping device that can be quickly removed from or secured to a user's person such as by securing it to the user's a belt loop or other outerwear. Likewise, the timekeeping device disclosed herein can be easily coupled to a golf bag, backpack or other object when it is inconvenient or not possible to have a watch placed upon a wrist. Also, as stated above, it is within the scope of the present invention to employ other carabiner-type closure mechanisms, such as those mentioned hereinabove.

Although described in the context of preferred embodiments, it should be realized that a number of modifications to these teachings may occur to one skilled in the art. As should be appreciated, the scope of the present invention is not limited to a particular configuration of the housing 12, the clip assembly 20 and/or the first member 21 or second member 22 thereof Rather, the present invention is directed to a unique integration of a timepiece and clip assembly having a biased, pivoting member for rapid and easy coupling of the integrated device onto a user's clothing or belt, outer garments, backpack, golf bag or other equipment such as, for example, a bicycle. Also, second member 22 may be disposed anywhere along the length of first member 21, and may open-up inwardly or outwardly, and further the positions of hinge point A and point B can of course be reversed, if desired.

While the invention has been particularly shown and described with respect to preferred embodiments thereof, it will be understood by those skilled in the art that changes in form and details may be made therein without departing from the scope and spirit of the invention.

We claim:

1. A timekeeping device comprising:

a clip assembly comprising a base region, a first member integrally formed with and extending from the base region, and a second member rotatably coupled to the first member at a hinge point, wherein the rotation of the second member is within a first plane; and;

a casing, located at the base region, comprising at least timekeeping functionality and a display for viewing displayed information, wherein a face of the display is at least essentially parallely alignable to the plane through which the second member rotates;

whereby pressure to the second member causes the second member to rotate relative to the first member about the hinge point to permit coupling of the timekeeping device to an object of interest.

2. A timekeeping device comprising:

a clip assembly comprising a base region and an integrally formed first member, wherein the first member includes a first end and a second end; and a second member rotatably coupled to one of the first end and second ends of the first member, wherein the second member extends between the first and second ends of the first member such that an opening is formed and perimetered by the base region, the first member and the second member;

a casing, located at the base region, comprising at least timekeeping functionality and a display for viewing displayed information, wherein the display is parallely alignable to a line that intersects the opening without intersecting the base region, the first member or the second member;

whereby pressure to the second member causes the second member to rotate relative to the first member about the hinge point to permit coupling of the timekeeping device to an object of interest.

3. A electronic device comprising:

a clip assembly comprising a base region, a first member integrally formed with and extending from the base region, and a second member rotatably coupled to the first member at a hinge point, wherein the rotation of the second member is within a first plane; and;

a casing, located at the base region, comprising at least timekeeping functionality and a display for viewing displayed information, wherein a face of the display is at least essentially parallelly alignable to the plane through which the second member rotates;

whereby pressure to the second member causes the second member to rotate relative to the first member about the hinge point to permit coupling of the electronic device to an object of interest.

4. An electronic device comprising:

a clip assembly comprising a base region and an integrally formed first member, wherein the first member includes a first end and a second end; and a second member rotatably coupled to one of the first end and second ends of the first member, wherein the second member extends between the first and second ends of the first member such that an opening is formed and perimetered by the base region, the first member and the second member;

a casing, located at the base region, comprising at least timekeeping functionality and a display for viewing displayed information, wherein the display is parallelly alignable to a line that intersects the opening without intersecting the base region, the first member or the second member;

whereby pressure to the second member causes the second member to rotate relative to the first member about the hinge point to permit coupling of the electronic device to an object of interest.

5. An electronic device comprising:

a clip assembly comprising a base region and an integrally formed first member, wherein the first member includes a first end and a second end; and a second member rotatably coupled to one of the first end and second ends of the first member, wherein the second member extends between the first and second ends of the first member such that an opening is formed and perimetered by the base region, the first member and the second member;

a casing, located at the base region, comprising at least a display for viewing displayed information, wherein the display is parallelly alignable to a line that intersects the opening without intersecting the base region, the first member or the second member;

whereby pressure to the second member causes the second member to rotate relative to the first member about the hinge point to permit coupling of the electronic device to an object of interest.

6. The timekeeping device as claimed in claim 1, wherein the object of interest is an article of clothing.

7. The timekeeping device as claimed in claim 1, wherein the base region includes a receptacle for receiving the casing.

8. The timekeeping device as claimed in claim 2, wherein the base region includes a receptacle for receiving the casing.

9. The electronic device as claimed in claim 3, wherein the base region includes a receptacle for receiving the casing.

10. The electronic device as claimed in claim 4, wherein the base region includes a receptacle for receiving the casing.

11. The electronic device as claimed in claim 5, wherein the base region includes a receptacle for receiving the casing.

12. The timekeeping device as claimed in claim 1, wherein the second member is spring biased relative to the first member.

13. The timekeeping device as claimed in claim 2, wherein the second member is spring biased relative to the first member.

14. The electronic device as claimed in claim 3, wherein the second member is spring biased relative to the first member.

15. The electronic device as claimed in claim 4, wherein the second member is spring biased relative to the first member.

* * * * *